United States Patent [19]

Florin

[11] Patent Number: 4,971,518

[45] Date of Patent: Nov. 20, 1990

[54] RADIAL FAN WITH INTEGRATED DUST SEPARATOR

[75] Inventor: Christian Florin, Zürich, Switzerland

[73] Assignee: Asea Brown Boveri Ltd., Baden, Switzerland

[21] Appl. No.: 337,739

[22] Filed: Apr. 13, 1989

[30] Foreign Application Priority Data

Apr. 30, 1988 [DE] Fed. Rep. of Germany ..... 3814721

[51] Int. Cl.[5] ..... F04D 29/70

[52] U.S. Cl. ..... 415/121.2; 55/451; 209/142; 209/144

[58] Field of Search ..... 415/169.1, 169.2, 121.2, 415/203, 207, 206, 208.1, 208.2, 144; 55/447, 450, 451; 241/79.1; 209/142, 143, 144, 154

[56] References Cited

U.S. PATENT DOCUMENTS

| | | | |
|---|---|---|---|
| 1,958,145 | 5/1934 | Jones | 415/144 |
| 2,325,221 | 7/1943 | Bretzlaff et al. | 415/169.1 |
| 2,970,234 | 1/1961 | Erickson | 415/208.2 |
| 3,191,364 | 6/1965 | Sylvan | 415/121.2 |
| 3,408,796 | 11/1968 | Murray | 415/121.2 |
| 3,796,511 | 3/1974 | Hansen | 415/206 |
| 4,155,681 | 5/1979 | Linko, III et al. | 415/169.1 |
| 4,349,311 | 9/1982 | Milz | 415/206 |
| 4,588,351 | 5/1986 | Miller | 415/121.2 |
| 4,808,067 | 2/1989 | Saulgeot | 415/169.1 |

FOREIGN PATENT DOCUMENTS

| | | | |
|---|---|---|---|
| 375843 | 9/1984 | Austria . | |
| 1963523 | 7/1967 | Fed. Rep. of Germany . | |
| 1801093 | 7/1970 | Fed. Rep. of Germany . | |
| 3546394 | 7/1987 | Fed. Rep. of Germany . | |
| 1021679 | 2/1953 | France | 415/144 |
| 2379772 | 9/1978 | France . | |
| 139906 | 7/1930 | Switzerland . | |
| 289973 | 7/1953 | Switzerland . | |
| 462309 | 10/1968 | Switzerland . | |

OTHER PUBLICATIONS

Elektrische Bahnen (Jul. 1987), "Die elektrischen Lokomotiven RE 414 der BT und der SZU mit Drehstromtechnik", pp. 2–9.

Sachs., "Elektrische Triebfahrzeuge", 2nd edition, vol. 1, pp. 721–728 (May 1973).

DE-ETZ-B, Bd. 9, H.11, Nov. 21, 1957, S. 460.

DE-VDI, H.4, Nov. 1952, Bericht des Fachausschusses fur Staubtechnik, 3. Seite, Abb. 3.

*Primary Examiner*—John T. Kwon

*Attorney, Agent, or Firm*—Oblon, Spivak, McClelland, Maier & Neustadt

[57] ABSTRACT

In a radial fan suitable in particular for traction vehicles, 10–15% of the conveyed air quantity is diverted radially from the cooling-air path by guide devices (10) which at the same time serve as a separator; the main proportion passes to the coolers after a 90° deflection. In this way, dirt particles such as dust, snow, spray water, etc, are effectively kept away from the coolers.

3 Claims, 2 Drawing Sheets

RADIAL FAN WITH INTEGRATED DUST SEPARATOR

TECHNICAL FIELD

The invention relates to a radial fan which is arranged coaxially in a cylindrical air-passage housing, having axial inflow and essentially axial outflow through an annular space between radial fan impeller and housing wall. To this end, the invention makes reference to a state of the art as represented in for example, the special off-print from the journal "Elektrische Bahnen" 7/1987, "Die elektrischen Lokomotiven RE 414 der BT und der SZU mit Drehstromtechnik" (publication No. CH-VT 1371 87D of the applicant), page 7, FIG. 10.

TECHNOLOGICAL BACKGROUND AND PRIOR ART

Modern electric traction vehicles require large quantities of cooling air to cool the electric and electronic apparatus installed on the traction vehicle and to cool the traction motors. This cooling air is drawn in via ventilation grilles or louvres by means of axial or radial fans. After flowing through the various coolers or the traction motors, the heated air escapes again into the open.

The intake routes must be designed in such a way that entrained dust, snow and rain are largely separated outside the components to be cooled. Previously customary separators require either large intake areas (e.g. grilles having mat filters) and periodic maintenance or else considerable space (e.g. acceleration filters) plus the installation of additional scavenging devices.

With ventilation grilles of specific construction, as described, for example, in the book by Sachs "Elektrische Triebfahrzeuge", 2nd edition, volume 1, published by Springer, Vienna/New York 1973, pages 721–728, the current requirements can no longer be fulfilled in certain cases.

A method of increasing the separating efficiency is described in Austrian Patent Specification No. 375,843. This reference discloses a centrifugal separator for separating dust, snow and drops of water from the cooling air for an electrical machine, consisting of a cylindrical housing, an airflow duct body and a collecting vessel, annular in cross-section and fixed to the cylindrical housing, for dust, snow and drops of water. Provided in the cylindrical housing is an axial counterflow blower consisting of two contra-rotating fans; provided on the air discharge side of the counterflow blower is an axial airflow-passage body which on the one side, at the air discharge side of the counterflow blower, has guide vanes, which are curved in a radially threedimensional manner, are fixed in the cylindrical housing and deflect the airflow spirally around the airflow-passage body, and on the other side, at its end, has guide vanes which are curved in opposite directions in a radially three-dimensional manner and are fixed on the inside to the cylindrical collecting vessel, which is fixed to the cylindrical housing and has an annular opening in the direction of the counterflow blower.

The collecting vessel is of helical configuration and has a nozzle-shaped outlet opening, the helix being designed so as to descend in the direction of this outlet opening.

Apart from the quite complicated type of construction of a combination of this type, the propagation of noise caused by the axial fans used in this arrangement is considerable or troublesome at the high speed necessary.

BRIEF DESCRIPTION OF THE INVENTION

Starting from the known art, the object of the invention is to create a radial fan having integrated dirt separation, which radial fan is distinguished by a small space requirement, acceptable noise generation and high separating efficiency.

This object is achieved according to the invention when, at the level of the fan impeller of the radial ventilator, the housing wall is provided over its entire periphery with guide devices which form between them outlet channels or orifices through which a fraction of the air conveyed by the radial ventilator can be conducted into a separating space which essentially completely surrounds the outflow space in an annular manner.

The guide devices are here preferably designed in one piece with the housing wall and are formed by wall parts bent by a few angular degrees out of the wall. In this way, they act as baffle plates on which dirt can be deposited intermediately, which dirt, however, is entrained on account of the high flow velocity in the outlet channel.

The quantity of scavenging air flowing through these channels can be adapted to the particular operating conditions, quantities of scavening air between 10 to 15% of the entire air quantity conveyed by the radial ventilator proving to be convenient.

In order to make allowance for extreme, fluctuating operating conditions, the guide devices can be designed as adjustable lamellae, which, for example, can be activated by a common adjusting and locking means, which is important, for example, for winter use, when large quantities of drifting snow have to be separated.

Further details and advantages of the invention are described more specifically below with reference to an exemplary embodiment shown in the drawing.

DETAILED DESCRIPTION OF THE INVENTION WITH REFERENCE TO AN EXEMPLARY EMBODIMENT

Figure 1:
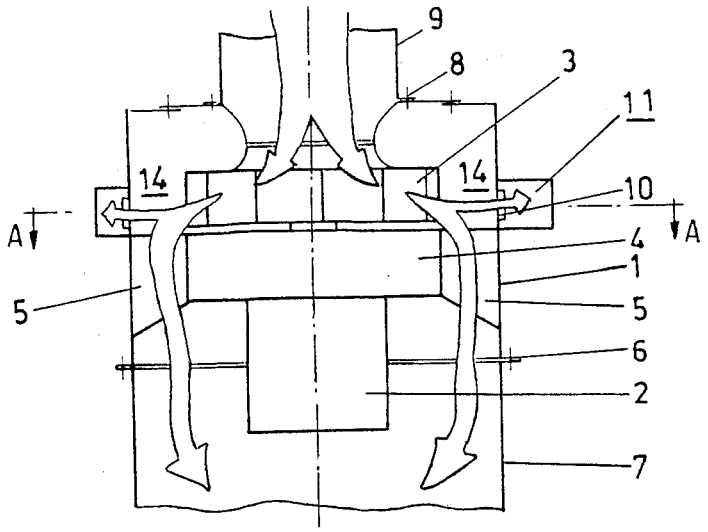
FIG. 1 shows a longitudinal section through a radial fan having integrated dirt separation.

In FIG. 1, a radial fan impeller 3 driven by a motor 2 is arranged concentrically in a cylindrical air-passage housing 1 and is held by a motor carrier 4. The motor carrier 4 is supported on the air-passage housing 1 via radial webs 5. On the outflow side, the air-passage housing 1 continues into an outflow duct 7 via a flanged connection 6. The air conveyed by the radial ventilator is supplied from there to the individual machine and plant parts to be cooled, such as air/oil coolers, traction motors, etc.

The end of the air-passage housing 1 on the inlet side is likewise connected via a flanged connection 8 to an inflow duct 9 which leads to the air-inlet openings on the upper part of the locomotive box.

At the level of the radial fan impeller 3, the wall of the air-duct housing 1 is provided with guide devices. In the example, these consist of lamellae 10 which are made in one piece with the wall, are bent outwards out of the latter and extend in a uniformly distributed manner over the entire wall periphery. A separating space 11 designed as an annular channel and having a cross-section which widens in the direction of rotation of the fan surrounds the wall zone formed by the bent-out lamellae 10. The separating space 11 is connected via a flange connection 12 to a duct 13 which preferably leads to the underside of the locomotive box.

Figure 2:
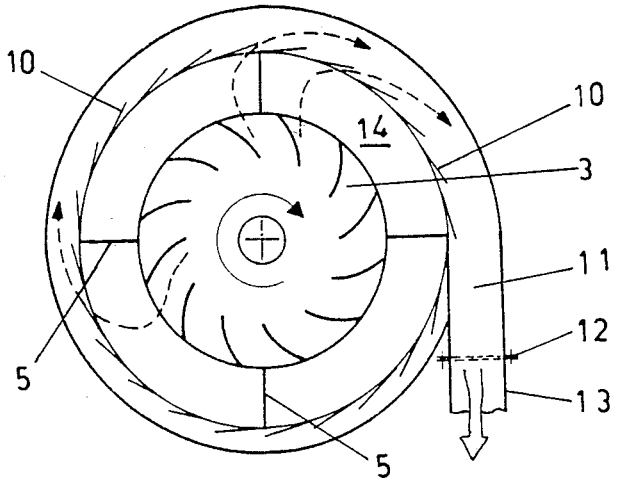
FIG. 2 shows a cross-section through FIG. 1 along its line A—A.

If dust, spray water, etc, pass with the intake air into the radial fan during operation of the latter, a variable centrifugal force acts on the air and these mass particles. The 90° deflection in the axial direction, which takes place immediately after discharge from the impeller, brings about a separation of air and mass particles contained in it and a direct separation of the mass particles, adhering with greater centrifugal force, on the lamellae 10. A fraction of the air, typically 10–15%, conveyed by the radial ventilator flows as scavenging air through openings or orifices formed in the intermediate spaces between the individual lamellae 10 and entrains the separated mass particles on account of the high flow velocity in the orifices. The spiral form of the separating space ensures that the separating action is roughly uniform over the entire periphery. Instead of a 360° spiral, as illustrated in FIG. 2, two 180° spirals can also be provided.

Figure 3:
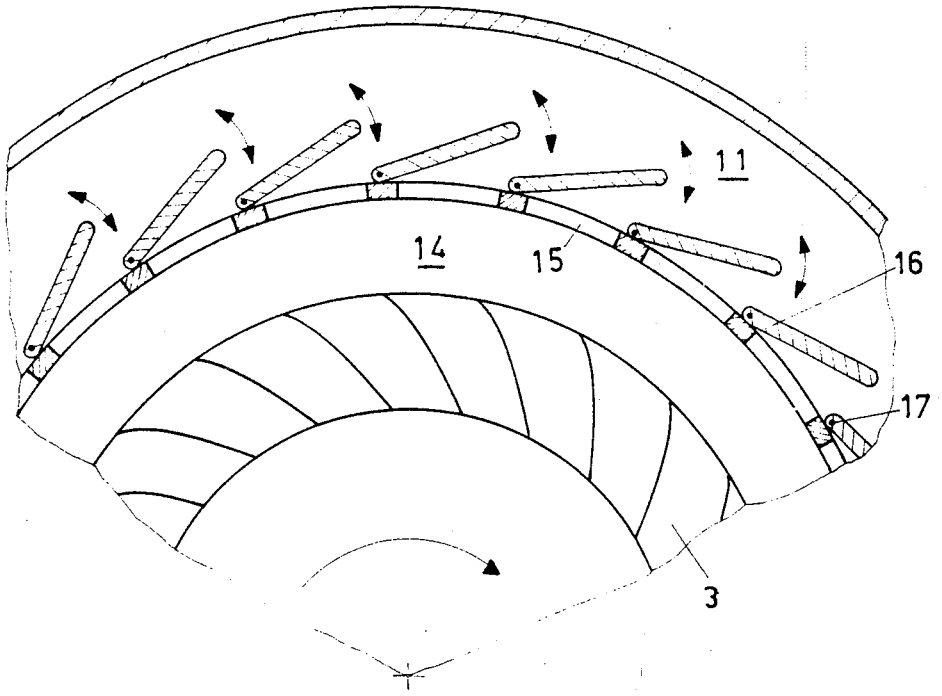
FIG. 3 shows a modification of FIG. 1 to an enlarged scale with the means of adjusting the guide device.

In order to make allowance for different quantities of dirt, e.g. during winter operation, the quantity of scavenging air can be increased by enlarging the orifices or adjusting the lamellae 10. This is schematically shown in the further development of the subject-matter of the invention in FIG. 3.

The connection between the outlet space 14 of the ventilator and the separating space 11 is made by apertures 15 in the wall of the air-passage housing 1. Lamellae 16, serving as a guide device, are pivotably fixed, e.g. via a self-locking hinge 17, to the webs remaining between the apertures. The opening angle of the lamellae 16 determines the quantity of scavenging air through the apertures 15.

I claim:

1. A radial fan having an integrated dust separator, comprising:

a cylindrical air passage housing having an inlet and having an outlet spaced from the inlet in the axial direction of the housing;

a radial fan impeller arranged in said housing between said inlet and said outlet for rotation about an axis substantially colinear with the axis of said housing, whereby airflow discharged radially from said impeller is deflected by substantially 90° in an annular outlet space of the impeller so as to flow substantially axially to said outlet;

an annular separating space surrounding said annular outlet space at the axial position of said impeller; and guide means in substantially the entire periphery of a wall of said housing separating said annular outlet space from said annular separating space and defining outlet channels for conveying a fraction of the airflow from said outlet space into said separating space, whereby dust in the airflow discharged from the impeller is conveyed with said fraction and separated from the remainder of said airflow.

2. The fan of claim 1 wherein said guide means comprise adjustable lamellae defining said outlet channels therebetween.

3. Radial fan according to claim 1, characterized in that the separating space (11) has a cross-section which widens in the direction of rotation of the radial fan impeller ventilator (3).

* * * * *